United States Patent [19]

Vos

[11] Patent Number: 4,728,340

[45] Date of Patent: Mar. 1, 1988

[54] FUEL COMPOSITION

[75] Inventor: Bron Vos, Amsterdam, Netherlands

[73] Assignee: Shell Oil Company, Houston, Tex.

[21] Appl. No.: 20,010

[22] Filed: Feb. 27, 1987

[30] Foreign Application Priority Data

Mar. 6, 1986 [GB] United Kingdom ..... 8605535

[51] Int. Cl.[4] ..... C10L 1/18; C10L 1/22

[52] U.S. Cl. ..... 44/62; 44/71; 44/72; 44/77

[58] Field of Search ..... 44/62, 63, 71, 72, 77

[56] References Cited

U.S. PATENT DOCUMENTS

| | | | |
|---|---|---|---|
| 3,231,587 | 1/1966 | Rense | 252/51.5 A |
| 4,122,033 | 10/1978 | Black | 252/400 A |
| 4,357,148 | 11/1982 | Graiff | 44/62 |
| 4,448,586 | 5/1984 | Weidig | 44/62 |
| 4,549,882 | 10/1985 | Knapp | 44/63 |

*Primary Examiner*—Jacqueline V. Howard

*Attorney, Agent, or Firm*—Kimbley L. Muller

[57] ABSTRACT

A fuel composition is disclosed comprising a major amount of base fuel and a minor amount of an additive (a) being a polyhydric alcohol ester of a succinic acid derivative having as substituent on at least one of its α-carbon atoms an unsubstituted or substituted aliphatic hydrocarbon group having from 20 to 500 carbon atoms or of a succinic acid derivative having on one of its α-carbon atoms an unsubstituted or substituted aliphatic hydrocarbon group having from 20 to 500 carbon atoms which is connected to the other α-carbon atom by means of a hydrocarbon moiety having from 1 to 6 carbon atoms forming a ring structure, and further a minor amount of an additive (b) being an aliphatic polyamine containing at least one hydrocarbon chain having a number average molecular weight in the range from 500 to 10,000 attached to nitrogen and/or carbon atoms of the alkylene radicals connecting the amino nitrogen atoms.

15 Claims, No Drawings

FUEL COMPOSITION

The present invention relates to a fuel composition with an improved cleanliness performance.

Owing to the acknowledgement that mineral fuel supply will expire some day and owing to the price increase of mineral fuels in connection with this acknowledgement, other organic compounds are screened for their usefulness as fuel components. It has been found that oxygenates such as alcohols, ethers, ketones, aldehydes and esters are relatively fit for such use. These oxygenates, however, tend to cause a deterioration of engine cleanliness performance as regards the fuel inlet system, leading to corrosion on carburetor and valves. A known additive which is to improve the cleanliness performance of fuels is described in British patent specification No. 1,309,907. This additive, however, a polyamine, is not capable of counteracting the corrosion completely. It has now been found that fuel compositions containing a polyhydric ester of certain succinic acid derivatives in combination with a polyamine prevent corrosion and show increased cleanliness performance.

Accordingly, the present invention relates to a fuel composition comprising a major amount of base fuel and a minor amount of an additive (a) being a polyhydric alcohol ester of a succinic acid derivative having as substituent on at least one of its α-carbon atoms an unsubstituted or substituted aliphatic hydrocarbon group having from 20 to 500 carbon atoms or of a succinic acid derivative having from 20 to 500 carbon atoms or of a succinic acid derivative having on one of its α-carbon atoms an unsubstituted or substituted aliphatic hydrocarbon group having from 20 to 500 carbon atoms which is connected to the other α-carbon atom by means of a hydrocarbon moiety having from 1 to 6 carbon atoms forming a ring structure, and further a minor amount of an additive (b) being an aliphatic polyamine containing at least one hydrocarbon chain having a number average molecular weight in the range of from 500 to 10,000 attached to nitrogen and/or carbon atoms of the alkylene radicals connecting the amino nitrogen atoms.

It is obvious that the fuel composition according to the invention not necessarily has to comprise an oxygenates-containing base fuel. It is possible to use the additive combination in purely hydrocarbonaceous base fuels. Suitable base fuels include gasoline, kerosine, diesel fuel and heavy gas oil. Preferably, the base fuel is a gasoline. The amount of oxygenates in the base fuel, if present, may vary over a wide range, from practically no oxygenate being present to a base fuel which substantially completely consists of oxygenates. Preferably, the amount of oxygenates is between 0.1 and 25% vol. of the base fuel. The nature of the oxygenates is not of great importance in relation to the effect of additives (a) and (b). Suitable alcohols include $C_{1-6}$ alkanols. Suitable ethers are those having 2 to 20 carbon atoms; they are preferably branched, when used in gasoline. Suitable ketones and aldehydes have a similar length as the ethers. Ethers, used in fuels, include lower esters of fatty acids, e.g. $C_{1-8}$ alkyl esters of $C_{12-22}$ fatty acids and vegetable oils. Alcohols and ethers are most commonly used in gasoline.

The nature of the substituent(s) of additive (a) is of importance since it determines to a large extent the solubility of the compound in the base fuel. The aliphatic hydrocarbon group is suitably derived from a polyolefin, the monomers of which have 2 to 6 carbon atoms. Thus, convenient are polyethylene, polypropylene, polybutylenes, polypentenes, polyhexenes or mixed polymers. Particularly preferred is an aliphatic hydrocarbon group which is derived from polyisobutylene.

The hydrocarbon group includes an alkyl and an alkenyl moiety. It may contain substituents. One or more hydrogen atoms may be replaced by another atom, for example halogen, or by a non-aliphatic organic group, e.g. an (un)substituted phenyl group, a hydroxy, ether, ketone, aldehyde or ester. A very suitable substituent in the hydrocarbon group is at least one other succinate ester group, yielding a hydrocarbon group having two or more succinate moieties.

The chain length of the aliphatic hydrocarbon group is of importance too, for the solubility of the additive (a) in the base fuel. The group has 20 to 500 carbon atoms. When a polyolefin is used as substituent the chain length is conveniently expressed as the number average molecular weight. The number average molecular weight of the substituent, e.g. determined by osmometry, is advantageously from 400 to 2000.

The succinic acid derivative may have more than one $C_{20-500}$ aliphatic hydrocarbon group attached to one or both α-carbon atoms. Preferably, the succinic acid has one $C_{20-500}$ aliphatic hydrocarbon group on one of its α-carbon atoms. On the other α-carbon atoms conveniently no substituent or only a rather short hydrocarbon e.g. $C_1$–$C_6$ alkyl group is attached. The latter group can be linked with the $C_{20-500}$ hydrocarbon group, forming a ring structure.

The preparation of the substituted succinic acid derivatives is known in the art. In case a polyolefin is used as substituent the substituted succinic acid can conveniently be prepared by mixing the polyolefin, e.g. polyisobutylene, with maleic acid of maleic anhydride and passing chlorine through the mixture, yielding hydrochloric acid and polyolefin-substituted succinic acid, as described in British patent specification Nos. 1,055,359 and 1,543,359 or U.S. Pat. No. 3,576,742.

From e.g. Netherlands patent application No. 74512057 it is known to prepare hydrocarbon-substituted succinic anhydride by reacting thermally a polyolefin with maleic anhydride. These adducts are within the scope of the invention. The products can also be prepared by reaction of maleic anhydride with halogen-substituted polyalkenes or with polyalkenes in the presence of halogens, as is described in French patent specification No. 2,042,538 and British patent specification No. 1,356,802.

Suitable polyhydric alcohols to from the esters of additive (a) include dihydric and trihydric alcohols, such as e.g. glycol, 1,2 or 1,3-dihydrodypropane, glycerol, di- or trihydroxybutane, di- or trihydroxypentane, or di- or trihydroxyhexane. Teritols, pentitols and hexitols are also suitable. The alcohols may be branched or unbranched. Esters of succinic acid derivatives and polyhydric alcohols having at least three hydroxy groups are preferred. Of these, glycerol, pentaerythritol and mannitol are particularly suitable.

The fuel composition according to the invention may comprise monoesters, diesters or a mixture of mono and diesters of a succinic acid derivative. Especially when monoesters, are prepared, there is a chance that more than one hydroxyl group per alcohol reacts with the acid function to yield an alkylene disuccinate derivative. Preferably, the fuel composition according to the invention contains esters of polyhydric alcohols, in which only one hydroxy group has reacted with the succinic acid derivative.

The esters of the substituted succinic acids show already the desired effect when they are included in the fuel composition in a very small amount. From an economical point of view the amount thereof is as little as possible provided that the desired effect is evident. Suitably, the fuel composition according to the invention contains from 1 to 1000 ppmw of additive (a), in particular from 25 to 750 ppmw.

The polyamines used as additive (b) in the composition according to the invention may be primary, secondary or tertiary. Preferred are polyalkylene polyamines in which the alkylene groups have from 2 to 5 carbon atoms, such as ethylene diamine, diethylene triamine, triethylene tetramine, tetraethylene pentamine, propylene- or butylene diamine. Other suitable polyamines include $\alpha,\omega$-diamines of alkylene groups containing 3 to 18 carbon atoms. Preferably, as polyamine a diamine is used. In particular a polyamine is preferred which contains in addition to the hydrocarbon chain(s) at least one organic group having from 1 to 10 carbon atoms bound to nitrogen.

Such an organic group can be bound to the same nitrogen atom as the one to which a hydrocarbon chain having a number average molecular weight of from 500 to 10,000 is bound. By organic group should be understood any monovalent radical, built up substantially from carbon and hydrogen, in which however dependent on the chosen method of preparation of the substituted polyamine, minor amounts of one or more other elements, e.g. halogen or oxygen, may be present. Examples of suitable organic groups are straight or branched alkyl groups which may carry aromatic or cycloaliphatic hydrocarbon substituents. The organic groups having up to 10 carbon atoms are advantageously selected from alkyl groups with an unbranched carbon chain. Preference is given to substituted polyamines in which the organic group(s) has (have) less than 5 carbon atoms, methyl groups being particularly preferred.

Examples of such suitable substituted polyamines are compounds having a hydrocarbon chain with a number average molecular weight between 500 and 10,000 attached to an N-alkyl ethylene diamino or N-alkyl propylene diamino group. Advantageously the polyamine moiety applied is an N'-substituted-N,N-dimethyl-1,3-diamino propane moiety.

The hydrocarbon chain present in the polyamine, preferably has a number average molecular weight between 600 and 2,000. The chain is advantageously a polymer constituted of recurrent olefinic units, such as ethylene, propylene, butylene, butadiene and the like. Generally such olefinic units contain 2 to 8 carbon atoms.

It is understood that instead of ethylene or propylene a diolefin may be used which after polymerization and hydrogenation yields a saturated polymer or copolymer of ethylene and/or propylene units. So, it is possible to hydrogenate the product of the 1,4-polymerization of butadiene to obtain polyethylene. Hydrogenation of the product of the 1,4-polymerization of isoprene yields a copolymer of ethylene and propylene. Preferably, the hydrocarbon chain consists of $C_3$- and/or $C_4$-monoolefinic units. Especially preferred are polymers consisting of isobutylene units.

The polymer advantageously connected directly to a nitrogen atom of the polyamine has preferably a number average molecular weight ranging from 500 to 1500, corresponding with 35 to 105 carbon atoms in the chain. The most preferred polyamine is N-polyisobutylene-N',N'-dimethyl diamino propane, in which the polyisobutylene moiety has a number average molecular weight ranging from 500 to 1500.

The concentration of additive (b) in the fuel composition may vary within wide limits. Suitably, the amount ranges from 10 to 1000 ppmw, in particular from 100 to 750 ppmw, based on the base fuel. The relative amounts of additive (a) and (b) are preferably such that the weight ratio of additive (a) to additive (b) ranges from 1:1 to 1:20.

The fuel composition according to the invention may further contain other additives. When gasoline is the base fuel, the fuel composition may contain a lead compound as an anti-knock additive. It can also contain antioxidants, such as 2,6-di-t-butylphenol, or phenylenediamines, e.g. N,N'-di-sec-butyl-p-phenylenediamine, or anti-knock additives other than lead compounds. When diesel fuel is the base fuel, the composition may comprise pour point depressants such as copolymers of ethylene and vinylesters, e.g. vinyl acetate, or cetane improvers such as organic nitrates or nitrites.

When gasoline is used as base fuel, the fuel composition suitably contains a minor amount of a spark-aiding additive as described in British patent application No. 8515974. This additive comprises an alkali metal or alkaline earth metal salt of a succinic acid derivative having as substituent on at least one of its $\alpha$-carbon atoms an unsubstituted or substituted aliphtic hydrocarbon group having from 20 to 200 carbon atoms or of a succinic acid derivative having as a substituent on one of its $\alpha$-carbon atoms an unsubstituted or substituted aliphatic hydrocarbon group having from 20 to 200 carbon atoms which is connected to the other $\alpha$-carbon atom by means of a hydrocarbon moiety having from 1 to 6 carbon atoms, forming a ring structure. Advantageously, the dibasic salt is present. In particular, potassium and cesium salts are preferred. The aliphatic hydrocarbon group is suitably a polyolefin, in particular polyisobutylene having from 35 to 150 carbon atoms. The amount of this spark-aiding additive is preferably from 1–100 ppmw of alkali metal or alkaline earth metal, based on the base fuel.

Another suitable additive is a polyolefin, and especially a polyisobutylene compound, having from 20 to 175 carbon atoms, preferably from 35 to 150 carbon atoms. It is advantageously present in the fuel composition in an amount from 100 to 1200 ppmw, based on the base fuel. This additive can be used in any base fuel, in particular in gasoline, kerosine and diesel fuel.

The additives (a) and (b) can be added to the base fuel separately or they can be blended and added to the base fuel together. A preferred method of adding these additives is first to prepare a concentrate of these additives and then add this concentrate in a proper amount to the base fuel.

The invention therefore further relates to a concentrate, suitable for use in a fuel composition, comprising from 1 to 90%w of additive (a) as defined hereinbefore, from 5 to 90%w of additive (b) as defined hereinbefore, and a fuel-compatible diluent, the weight percentages being based on the weight of the diluent. Suitable fuel-compatible diluents are hydrocarbons, such a heptane, alcohols or ethers, such as methanol, ethanol, propanol, 2-butoxyethanol, methyl tert-butyl ether, polyglycols or polypropyleneglycols, and the like. Preferably the diluent is an aromatic hydrocarbon solvent, such as xylene, toluene, mixtures thereof, or a mixture of such as an aromatic hydrocarbon solvent with a $C_{1-5}$ alcohol. The concentrate may contain other additives, e.g. a dehazer, in particular a polyether type ethoxylated alkylphenolformaldehyde resin.

The invention will further be elucidated by means of the following Examples.

EXAMPLE I

To test the corrosive activity of gasolines the equipment and procedure described in ASTM 1384 were employed, with the following modifications. Specimens of metals typically present in an automotive inlet system are immersed in a fuel with aeration for 25 hours at 88° C. The metals selected were steel (SAE 1020), brass (SAE CA260) and aluminum (SAE 329), all of them being in electrical contact. The gasoline consisted of a base fuel comprising 95%w n-decane, 3%w methanol and 2%w t-butanol. To this fuel 0.2% formic acid was added. Formic acid is believed to be formed from oxygenates. To this mixture additives (a) and (b) were added. Additive (b) was N-polyisobutylene-N',N'-dimethyl-1,3-diamino propane in which the polyisobutylene chain had a number average molecular weight of 1450. Additive (a) was the pentaerythritol diester of polyisobutylene-substituted succinic acid, the polyisobutylene group having a number average molecular weight of 950. The structure of the polyisobutylene-substituted succinic acid derivative was that of the Diels-Alder addut of polyisobutylene and maleic acid.

For comparison, another additive, I, was tested, i.e. a commercial formulation containing carboxylic acid derivatives, nitrogen heterocyclics and amines, marketed by BASF under the trademark KEROKORR 5327.

Results of the tests are indicated in Table I.

TABLE I

| Additive concentration ppmw | | | Weight change mg/in$^2$ | | |
|---|---|---|---|---|---|
| (a) | (b) | I | Steel | Aluminium | Brass |
| — | — | — | −1.3 | 0 | −1.5 |
| — | 100 | — | −1.3 | 0 | −1.5 |
| — | 500 | — | −1.3 | 0 | −1.5 |
| 50 | 500 | — | −0.1 | +0.1 | −0.8 |
| 100 | 500 | — | −0.7 | +0.3 | −0.9 |
| 250 | 500 | — | −0.5 | 0 | −1.1 |
| 500 | 500 | — | −0.2 | −0.1 | −0.6 |
| — | 500 | 50 | −0.2 | −0.1 | −1.5 |
| — | 500 | 100 | −0.1 | +0.4 | −1.2 |
| — | 500 | 250 | −0.1 | +0.1 | −1.5 |

From the results it is apparent that the combination of additives (a) and (b) give excellent results, especially in counteracting corrosion on brass. The weight increase of the aluminum specimens is due to the compensation of the corrosive weight loss by a weight gain by deposit accumulation, possibly originating from the corroded brass specimen.

EXAMPLE II

Similar tests as described in Example I were carried out, but the time duration was set to 8 days at a temperature of 50° C.

The results are presented in Table II.

TABLE II

| Additive concentration ppmw | | | Weight change mg/in$^2$ | | |
|---|---|---|---|---|---|
| (a) | (b) | I | Steel | Aluminium | Brass |
| — | 500 | — | −0.2 | +0.3 | −1.7 |
| 50 | 500 | — | −0.1 | +0.5 | −0.8 |
| — | 500 | 50 | −0.1 | +0.4 | −1.0 |

These results are in line with the results of Experiment I.

What we claim as our invention:

1. A fuel composition comprising a major amount of base fuel and a minor amount of two additives comprising (1) a polyhydric alcohol ester of a succinic acid derivative having as substituent on at least one of its α-carbon atoms an unsubstituted or substituted aliphatic hydrocarbon group having from 20 to 500 carbon atoms or a succinic acid derivative having on one of its α-carbon atoms an unsubstituted or substituted aliphatic hydrocarbon group having from 20 to 500 carbon atoms connected to a second α-carbon atoms of said succinic acid derivative by means of a hydrocarbon moiety having from 1 to 6 carbon atoms forming a ring structure, and (2) a minor amount of an additive comprising an aliphatic polyamine having alkylene radicals connecting amino nitrogen atoms and containing at least one hydrocarbon chain having an average molecular weight in the range from 500 to 10,000 attached to a nitrogen and/or carbon atom of said alkylene radicals connecting the amino atoms of the aliphatic polyamine.

2. The fuel composition of claim 1, wherein said fuel is selected from the group consisting of gasoline, kerosine, diesel fuel, and heavy gas oil.

3. The fuel composition of claim 1 wherein said base fuel comprises oxygenates.

4. The fuel composition of claim 3, wherein the amount of oxygenates ranges from 0.1 to 25%v/v, based on the volume base fuel.

5. The fuel composition of claim 1 wherein said aliphatic hydrocarbon group of said derivative of succinic acid is derived from a polyolefin, the monomers of which have 2 to 6 carbon atoms.

6. The fuel composition of claim 5, wherein the monomer is isobutylene.

7. The fuel composition of claim 1 wherein said aliphatic hydrocarbon group of said derivative of succinic acid has from 35 to 150 carbon atoms.

8. The fuel composition of claim 1 wherein said first additive is an ester derived from a polyhydric alcohol having at least three hydroxyl groups.

9. The fuel composition of claim 8, wherein the polyhydric alcohol is selected from the group of glycerol, pentaerythritol or mannitol.

10. The fuel composition of claim 1 wherein the amount of said first additive ranges from 1 to 1000 ppmw.

11. The fuel composition of claim 1 wherein said hydrocarbon chain of said second additive is constituted of recurrent $C_3$- or $C_4$-mono-olefin units, forming a polymer.

12. The fuel composition of claim 1 wherein said second additive comprised a hydrocarbon chain having at least one $C_{1-10}$ organic group, attached to a nitrogen atom.

13. The fuel composition of claim 12 wherein said second additive is N-polyisobutylene-N',N'-dimethyl-1,3-diamino propane.

14. The fuel composition of claim 13 wherein said N-polyisobutylene-N',N'-dimethyl-1,3-diamino propane is present in a range of 1 to 1000 ppmw.

15. A concentrate suitable for use in a fuel composition comprising a minor amount of two additives in said fuel composition:

(1) a polyhydric alcohol ester of a succinic acid derivative having as a substituent on at least one of its α-carbon atoms an unsubstituted or substituted aliphatic hydrocarbon group having from 20 to 500 carbon atoms or a succinic acid derivative having on one of its α-carbon atoms an unsubstituted or substituted aliphatic hydrocarbon group having from 20 to 500 carbon atoms connected to a second α-carbon atom of said succinic acid derivative by means of a hydrocarbon moiety having from 1 to 6 carbon atoms forming a ring structure; and (2) an aliphatic polyamine having alkylene radicals connecting amino nitrogen atoms and containing at least one hydrocarbon chain having an average molecular weight in the range from 500 to 10,000 attached to a nitrogen and/or carbon atom of the alkylene radicals connecting the amino nitrogen atoms of the aliphatic polyamine.

* * * * *